United States Patent [19]

Dougherty et al.

[11] Patent Number: 4,710,670

[45] Date of Patent: Dec. 1, 1987

[54] FRONT ASSEMBLY SYSTEM FOR A TENSION MASK COLOR CATHODE RAY TUBE

[75] Inventors: Lawrence W. Dougherty, Sleepy Hollow; James R. Fendley, Arlington Heights, both of Ill.

[73] Assignee: Zenith Electronics Corporation, Glenview, Ill.

[21] Appl. No.: 832,559

[22] Filed: Feb. 21, 1986

[51] Int. Cl.[4] ..... H01J 29/07; H01J 29/02

[52] U.S. Cl. ..... 313/407; 313/408; 313/402

[58] Field of Search ..... 313/402, 407, 408

[56] References Cited

U.S. PATENT DOCUMENTS

| | | | |
|---|---|---|---|
| 2,761,990 | 9/1956 | Amdursky et al. | 313/70 |
| 2,951,179 | 8/1960 | Evans | 313/402 X |
| 3,440,469 | 4/1969 | Bradu et al. | 313/89 |
| 3,489,966 | 1/1970 | Bradu et al. | 313/83 |
| 3,502,942 | 3/1970 | Khan et al. | 315/31 |
| 3,541,373 | 11/1970 | Barr | 313/85 |
| 3,638,063 | 1/1972 | Tachikawa et al. | 313/348 |
| 3,873,874 | 3/1975 | Shinal | 313/402 |
| 3,894,321 | 7/1975 | Moore | 29/25.15 |
| 3,898,510 | 8/1975 | Davis et al. | 313/482 |
| 4,069,567 | 1/1978 | Schwartz | 20/25.15 |
| 4,344,015 | 8/1982 | Marschka | 313/466 |
| 4,547,696 | 10/1985 | Strauss | 313/407 |
| 4,571,521 | 2/1986 | Gallaro et al. | 313/402 |

FOREIGN PATENT DOCUMENTS

| | | | |
|---|---|---|---|
| 121628 | 10/1984 | European Pat. Off. | 313/402 |
| 1163495 | of 0000 | United Kingdom . | |

*Primary Examiner*—David K. Moore
*Assistant Examiner*—K. Wieder
*Attorney, Agent, or Firm*—Ralph E. Clarke, Jr.

[57] ABSTRACT

A front assembly system for a tension mask color cathode ray tube is disclosed wherein a novel high-voltage conduit is formed between the funnel coating of the tube and the mask to a shadow-mask supporting frame. Also, a magnetic shielding combination is formed comprising an internal magnetic shield and the frame. The magnetic shield effectively extends from the inner surface of the faceplate through the frame and into the funnel a predetermined distance. The frame multi-functionally serves to mechanically support the mask, the shield and the interconnecting means to electrically interconnect the conductive funnel coating, the conductive screen and the mask, and to magnetically interconnect the shield and the mask. The magnetic shielding combination according to the invention is formed by the frame and the shield to enhance the shielding of the electron beams from stray magnetic flux transverse to the tube axis.

4 Claims, 3 Drawing Figures

FRONT ASSEMBLY SYSTEM FOR A TENSION MASK COLOR CATHODE RAY TUBE

CROSS-REFERENCE TO RELATED APPLICATIONS AND PATENTS

This application is related to but no way dependent upon copending applications Ser. Nos. 538,001 now U.S. Pat. No. 4,593,224, and 538,003 filed Sept. 30, 1983; 572,088 filed Jan. 18, 1984, now. U. S. Pat. No. 4,547,696; 572,089 filed Jan. 18, 1984 now U.S. Pat. No. 4,595,857; Ser. No. 729,020 filed Apr. 30, 1985; 725,040 filed Apr. 19, 1985; 729,015 filed May 17, 1985; 758,179 filed Jul. 23, 1984; and 832,493 filed Jan. 21, 1986 all of common ownership herewith.

BACKGROUND OF THE INVENTION

This invention relates generally to color cathode ray picture tubes, and is specifically addressed to an improved front assembly system for color tubes having shadow masks of the tensed foil type.

A color cathode ray tube typically includes three electron guns arranged in a delta or in-line configuration. Each gun projects an electron beam through the apertures of a shadow mask, also called a "color selection electrode," onto assigned target areas located on the inner surface of the faceplate. The target areas comprise a pattern of phosphor deposits typically arranged in groups of triads of dots or lines. Each of the triads consists of a deposit of a red-light-emitting, green-light emitting, and blue-light-emitting phosphor. To increase the apparent brightness of the display, and to minimize the incidence of color impurities which can result if a beam falls upon an unassigned phosphor deposit, the target area may include a layer of darkish light-absorbing material called a "grille" that surrounds and separates each of the dots or lines, and which serves as a guardband in case of beam misregistration. This type of screen is known as a "matrix screen" and "black surround" screen.

The area enclosed by the funnel and the shadow mask of a cathode ray tube is typically established as a field-free region for the excursion of the electron beams that selectively excite the pattern of phosphor deposits. The field-free region is established by charging certain inner components to a common high potential, typically in the range of 20–25 kilovolts. The components so charged typically include the conductive coating deposited on the inner surface of the funnel, and the shadow mask.

The phosphor deposits on the inner surface of the faceplate of the cathode ray tube are typically covered with a conductive film of aluminum. The aluminizing process comprises the deposition of an electron-pervious metallic film; that is, a film transparent to the flow of electrons comprising the three beams. The film increases the brightness of the display by acting as a mirror to reflect toward the viewer the visible light produced by the phosphors when activated by the electron beams. The film also carries the high-voltage charge to act as an electron-attractive ultor electrode for the display. The thickness of the film is typically about 2,000 Angstroms.

Stray magnetic fields can adversely affect the performance of color cathode ray tubes. The magnetic field of the earth is the primary offender. An unintercepted field can cause the electron beams to deviate from the normal landing area, resulting in color impurities. Terrestrial magnetic fields comprise paths of flux having both vertical and horizontal components. The flux path that has the greatest effect on beam landing is that which is transverse to the tube axis. Interception of most of the terrestrial magnetic flux can be accomplished by installing a magnetically permeable metallic shield either externally to the tube envelope, or internally. When installed internally, the shield is conventionally attached to the shadow mask, and extends rearwardly from the mask a predetermined distance into the tube envelope. The shield is usually designed so that, when in conjunction with the shadow mask, it completely encloses the major field-free excursion area of the electron beams, but it does not extend beyond the forward limit of the shadow mask.

The high potential required for tube operation is typically introduced into the tube envelope through an vacuum-tight electrical receptacle termed an anode button, the inner face of which is in contact with the conductive coating on the inner surface of the funnel. The potential on the funnel conductive coating is conveyed to the electron gun by spring means which extend from the forward electrode of the gun. The potential is also applied to the shadow mask, usually by spring means extending from the mask and in contact with the internal coating. The coating of electrically conductive aluminum on the phosphor deposits is also electrically charged. The electrical conduit from the electrically charged shadow mask to the aluminum coating is usually by means of a painted-on conductive "mustache" which is in contact with both the mask and the aluminum coating. If there is an internal magnetic shield, it too may carry the high potential; the electrical conduit from the mask to the shield is usually by some form of spring means.

U.S. Pat. No. 3,894,321 to Moore, of common ownership herewith, is directed to a method for processing a color cathode ray tube having a thin foil mask sealed directly to the bulb. Included in the Moore disclosure is a description of the sealing of a foil mask between the juncture of the skirt of the faceplate and the funnel. The mask is shown as having two or more alignment holes near the corners of the mask which mate with alignment nipples in the faceplate. The nipples pass through the alignment holes to fit into recesses in the funnel. In another Moore embodiment, the front panel is shown as having a continuous ledge around the inner surface of the faceplate. The top surface of the ledge is spaced a Q-distance away from the faceplate for receiving the foil mask such that the mask is sealed within the tube envelope. In another embodiment, the ledges are two in number and located at the sides of the faceplate parallel with the y axis. An embodiment is also shown in which the faceplate is skirtless and essentially flat.

In U.S. Pat. No. 3,489,966 to Bradu et al., there is disclosed a cathode ray tube with a stainless steel post-focusing grid sealed between the sealing lands and the faceplate skirt and the funnel. The grid of wires is cut at the outer surface of the envelope, and an electrically conductive layer located on the exterior of the envelope coats the envelope zone which comprises the ends of the wires. A layer of sealing and insulative material laid over the conducting layer is said to provide for air-tightness and high-voltage integrity. The conductive layer also makes contact with a high-voltage connector for energizing the grid wires. In another configuration in which the high-voltage is applied to the screen the screen receives operating potential through a terminal which penetrates the faceplate skirt; this terminal in turn is connected to the screen by a conductive-paint layer.

A post-deflection cathode ray tube is disclosed in U.S. Pat. No. 3,502,942 to Kahn et al. A unitary color selection and focus-electrode assembly comprises a first electrode for color selection, and a second lens element formed as a mesh of electrical conductors. The color selection electrode and focus electrode assembly are insulated from each other, and each has a different potential thereon. The tube has two conductive coatings on the inside of the envelope, one of which is located on the internal surface of the funnel, but stops short of the plane of the electrode assembly. High voltage for beam acceleration is conducted to the coating through an anode button that penetrates the funnel. A flexible electrical conductor interconnects the color selection electrode with the funnel coating. The second coating is located on the inner surface of the faceplate skirt, and a high voltage for post-deflection focusing is conducted to the coating through a second anode button that penetrates the skirt. A separate spring-like connector projects from the PDF electrode to make contact with a second coating.

Barr in U.S. Pat. No. 3,541,373 discloses a cathode ray tube with a bifurcated spring bridging the shadow mask frame, and an internal conductive coating. The spring clips onto the rigid frame, or alternately, is welded to the shadow mask. The distal end makes contact with the inner conductive coating on the funnel which is electrically charged to a high potential. The novelty is said to lie in the bifurcation of the distal end, in which each of two independently operating tines has a different vibration frequency. The result is said to be a more shock-resistant connection and the avoidance of electrical interruption. Also, the positive contact is said to make possible the use of a weaker spring with reduced possibility of mechanical erosion of the conductive coating.

In Davis et al.—U.S. Pat. No. 3,898,510—there is set forth through-the-seal conductive means for traversing a CRT envelope seam to effect multiple connections therein. An internal spring-like conductive member straddles the seam at the junction of the funnel and the faceplate skirt to electrically connect the funnel internal conductive coating and the conductive coating on the screen. A conductive member extends through the seam to interconnect the conductive member with an external high voltage connector.

Marschka in U.S. Pat. No. 4,344,015 describes a screen contact means for a cathode ray tube. An anode button projecting through the funnel is attached to a screen contact assembly that conducts high voltage directly to the screen, while bridging the gap at which the funnel and faceplate are sealed together. A Nichrome foil member is placed beneath the screen contact point of the conductive member to serve as a non-abrading pad. A member attached transversely to the contact assembly provides for screen-pressure contact with the conductive coating on the inner surface of the funnel.

The following patents are also noted: 1,163,495 (GB); U.S. Pat. Nos. 2,761,990; 3,440,469; 3,638,063; 3,873,874; 3,894,321; 4,069,567; and 4,495,473.

OBJECTS OF THE INVENTION

It is a general object of the invention to provide enhanced performance in high-resolution or home entertainment type color cathode ray tubes that utilize a tensed foil shadow mask.

It is another object of the invention to provide means for electrically energizing an improved cathode ray tube front assembly system according to the invention.

It is a more specific object of the invention to provide a cathode ray tube front assembly system according to the invention having improved magnetic shielding means.

It is a specific object of the invention to provide a front assembly system for a tension mask color cathode ray tube that multifunctionally serves as an electrical conduit, a magnetic shield, and a mechanical support for the entire assembly.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in the figures of which like reference numerals identify like elements, and in which:

DESCRIPTION OF THE PREFERRED EMBODIMENT

The invention is useful in color tubes of various types including home entertainment and medium-resolution and high-resolution types for use in color monitors.

Figure 1:
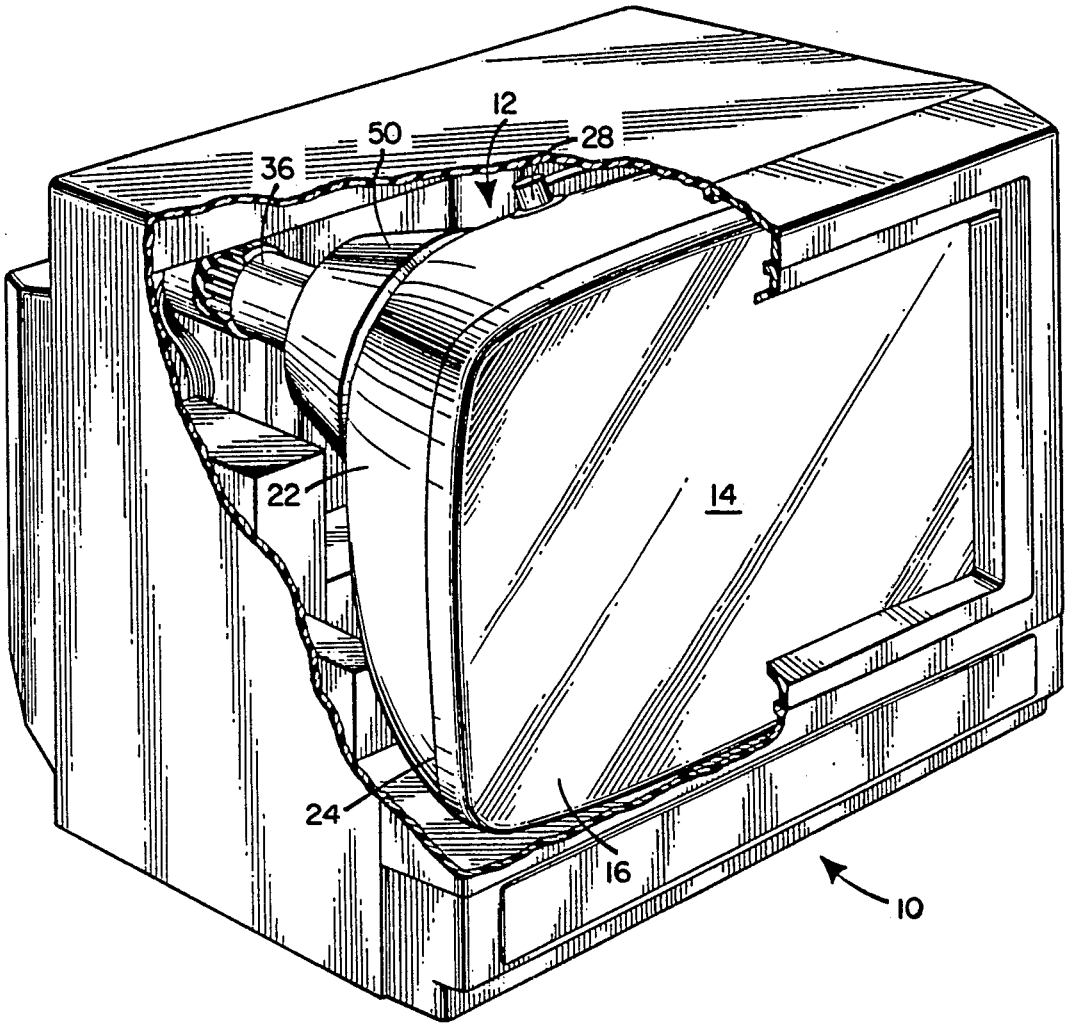
FIG. 1 is a cut-away view in perspective of a cabinet that houses a color cathode ray tube, showing certain major components which are the subject of the present invention.

FIG. 1 shows a novel video monitor 10 that houses a color cathode ray tube 12 having the novel front assembly system according to the invention. The design of the video monitor is the subject of copending design patent application Ser. No. 725,040 of common ownership herewith. The monitor, and the associated tube according to the invention, is notable for the flat imaging area 14 that makes possible the display of images in undistorted form. Imaging area 14 also offers a more efficient use of screen area as the corners are relatively square in comparison with the more rounded corners of the conventional cathode ray tube. The front assembly system according to the invention comprises the components described in the following paragraphs.

Figure 2:
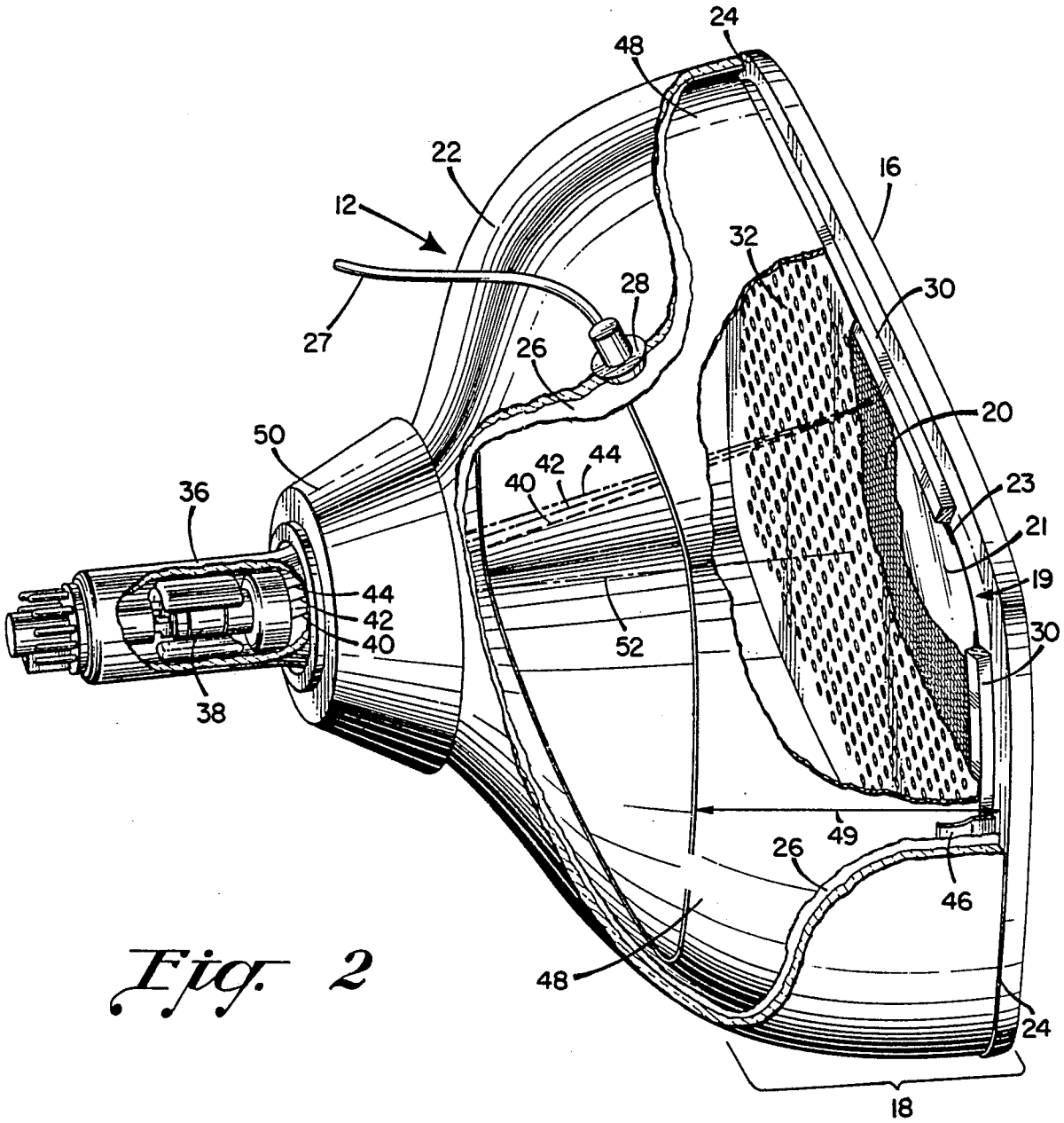
FIG. 2 is a side view in perspective of the color cathode ray tube of FIG. 1 showing another view of the components depicted in FIG. 1 together with cut-away sections that show internal components.

With reference also to FIG. 2, a front assembly system 18 is depicted, the scope of which is indicated by the bracket. The front assembly system 18 includes a glass faceplate 16 that may be flat, or alternately, "substantially flat" in that it may have finite horizontal or vertical radii, by way of example. Faceplate 16 is represented as having on its inner surface a centrally disposed electron beam target area 19 on which is disposed at least one pattern of phosphor deposits 20. An electrically conductive screen 21 is depicted schematically as being deposited on and overlaying the pattern of phosphor deposits 20. The electrically conductive screen 21 comprises a film of highly reflective, electrically conductive aluminum disposed on the pattern of phosphor deposits 20 by evaporative means or by hot stamping. The thickness of the aluminum is noted as being about 2,000 Angstroms.

A funnel 22 is shown as being attached to a peripheral sealing area 24 on the inner surface of faceplate 16. Funnel 22 is indicated as having an internal electrically conductive funnel coating 26 which is adapted to receive a high electrical potential. The potential is depicted as being applied through a high voltage conductor 27 attached to an anode button 28 which conducts the potential (the source of which is a high-voltage power supply through the wall of the funnel 22. The potential may be in the range of 18 to 32 kilovolts, by way of example.

An electrically conductive frame 30 is cemented to the inner surface of faceplate 16 between target area 19 and the peripheral sealing area 24, and encloses target area 19. The frame 30 in this embodiment is represented as being continuous, with a gap, indicated by the dashed line, left for purposes of illustration. Frame 30 supports in electrical union therewith a tensed metallic foil shadow mask 32. Shadow mask 32 may be of the planar, tensible foil type described and fully claimed in referent copending application Ser. No. 729,020. The screen 21 is noted as being electrically interconnected to frame 30. The interconnection may be made by a deposit 23 of an electrically conductive "dag," as is well-known in the art; several such deposits may be made to ensure positive electrical contact between screen 21 and frame 30. It is noted that electrical conduction between the screen 21 and frame 30 can also be provided by the the application of the grille "dag" (which is electrically conductive), or by the deposit of aluminum film, so the separate application of the dag may not be required.

A neck 36 in funnel 22 is depicted as housing an electron gun 38 which is represented as emitting three electron beams 40, 42 and 44 to selectively activate the pattern of phosphor deposits 20 on target area 19 after passing through the parallax barrier formed by shadow mask 32. Means for providing an electrical connection between the electrically conductive frame 30 and the internal electrically conductive funnel coating 26 may comprise spring means 46, by way of example.

A magnetically permeable internal magnetic shield 48 is shown as being attached to frame 30 and extending into funnel 22 a predetermined distance 49. The predetermined distance may comprise a rule-of-thumb dimension in which the distance is equal to one yoke diameter; that is, if the diameter of the yoke 50 is 5 inches, the internal magnetic shield 48 will extend into funnel 22 to a plane approximately 5 inches from the forward terminus of the yoke 50. Whatever means of measurement is used, it is essential that the distance the internal magnetic shield 48 extends into funnel 22 is such that there is no interference with the excursion of the electron beams 40, 42 and 44, yet adequate shielding is provided. As is well-known in the art, the yoke 50 provides for scanning the target area 19 with the three beams 40, 42 and 44.

The aforedescribed structure forms according to the invention a high-voltage conduit between the internal funnel coating 26 and the mask 32 through frame 30. The electrically conductive frame 30 according to the invention multifunctionally serves to mechanically support the interconnecting means, shown as being a spring 46, and the mask 32. Also, the electrically conductive frame 30 according to the invention electrically interconnects the conductive funnel coating 26, the electrically conductive screen 21 and mask 32.

In consonance with its multi-function purpose, the electrically conductive frame 30, noted as being cemented to the inner surface of faceplate 16 and peripheral sealing area 24, and enclosing target area 19, is also magnetically permeable according to the invention. Internal magnetic shield 48 is magnetically permeable as well. As a result, and according to the invention, a magnetic shielding combination is formed comprising the internal magnetic shield 48 and frame 30. The magnetic shield 48 according to the invention effectively extends from the inner surface of faceplate 16 through the frame 30 and into the funnel 22 the aforedescribed predetermined distance 49. As a result, frame 30 multifunctionally serves to magnetically interconnect the shield 48 and the mask 32, as well as to mechanically support the mask 32 and the shield 48, al1 according to the invention.

The front assembly system 18 according to the invention is notable for having a "to-screen" internal magnetic shield which includes the aforedescribed components. In addition, it is to be noted that the funnel 22 is attached to the peripheral sealing area 24 on the inner surface of faceplate 16, with the funnel 22 lying concentric with the anterior-posterior axis 52 of the tube 12. The frame 30, noted as being magnetically permeable, is affixed to the inner surface of faceplate 16 between the target area 19 and the peripheral sealing area 24. The magnetically permeable tensed foil shadow mask 32 is affixed to frame 30 a predetermined distance from the target area 19 to form a post-shadow mask beam-landing region defined by the mask 32, target area 19 and frame 30. The magnetically permeable internal magnetic shield 48, noted as being affixed to frame 30 and extending into funnel 22 a predetermined distance, defines, in conjunction with mask 32, a magnetically shielding pre-shadow-mask fieldfree region for the excursion of the electron beams 40, 42 and 44. Also in accordance with the invention, a "to-screen" post-shadow-mask magnetic shielding combination is formed by the frame 30 and shield 48.

Figure 2A:
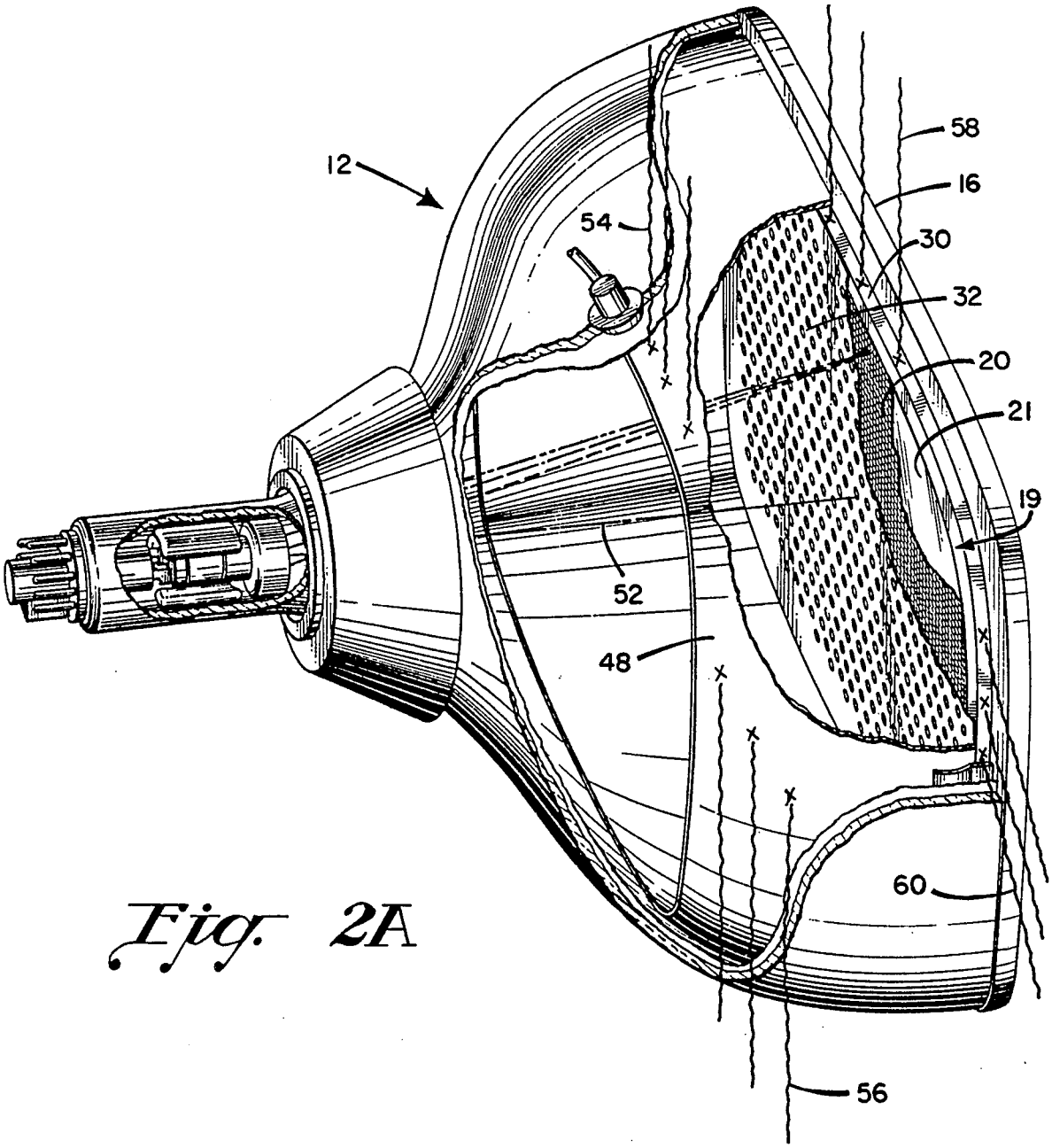
FIG. 2A is an enlarged view of a section of FIG. 2 indicating highly schematically the beneficial effect of the to-screen internal magnetic shield according to the invention.

The beneficial effect on tube performance of the front assembly system having a to-screen internal magnetic shield according to the invention is depicted in FIG. 2A, in which an enlarged section of the tube 12 is shown. As has been described, in prior art cathode ray tubes, interception of most of the terrestrial magnetic flux can be accomplished by installing a magnetically permeable magnetic shield either externally to the tube envelope, or internally, as in this example. The magnetic flux interception effect, in which paths of flux having a vertical component 54 and a horizontal component 56 are intercepted by the internal magnetic shield 48, is indicated highly schematically by FIG. 2A. (The internal magnetic shield 48 represented in the figure is of course a component of the novel magnetic shielding combination according to the invention.) In the to-screen internal magnetic shield according to the invention, the magnetically permeable magnetic shield 48 is affixed to a magnetically permeable frame 30 to form a post-shadow mask beam landing region of target area 19 which is defined by the shadow mask 32, the target area 19 and frame 30. The beneficial effect is depicted, again highly schematically, by the paths of flux 58 having a vertical component, and the paths of flux 60 having the horizontal component, being intercepted by the to-screen shielding provided by the magnetically permeable frame 30. This to-screen internal magnetic shielding system according to the invention enhances the shielding of the beams from stray magnetic flux transverse to the tube axis 52 in the critical electron beam landing region of the target area 19.

While a particular embodiment of the invention has been shown and described, it will be readily apparent to those skilled in the art that changes and modifications may be made in the inventive means without departing from the invention in its broader aspects, and therefore, the aim of the appended claims is to cover all such changes and modifications as fall within the true spirit and scope of the invention.

What is claimed is:

1. A front assembly system for a color cathode ray tube having an improved internal electrical interconnection system comprising:

a substantially flat faceplate having on its inner surface a centrally disposed target area on which is disposed at least one pattern of phosphor deposits;

a funnel attached to a peripheral sealing area on said inner surface of said faceplate, and having an internal electrically conductive funnel coating adapted to receive a high electrical potential;

an electrically conductive frame attached to said inner surface between said target area and said peripheral sealing area and enclosing said target area, said frame supporting in electrical union therewith a tensed metallic foil shadow mask;

an electrically conductive screen disposed on said pattern of phosphor deposits and electrically interconnected to said frame;

electrical interconnecting means for providing an electrical connection between said frame and said internal electrically conductive funnel coating;

whereby a high-voltage conduit is formed between said internal funnel coating and said mask through said frame, said electrically conductive frame multi-functionally serving to mechanically support said interconnecting means and said mask, and to electrically interconnect said conductive funnel coating, said conductive screen film, and said mask.

2. A front assembly system for a color cathode ray tube having an improved internal magnetic shielding system comprising:

a faceplate having on its inner surface a centrally disposed target area with at least one pattern of phosphor deposits;

a funnel attached to a peripheral sealing area on said inner surface of said faceplate;

a magnetically permeable frame attached to said inner surface between said target area and said peripheral sealing area and enclosing said target area, said frame supporting a magnetically permeable tensed foil shadow mask;

a magnetically permeable internal magnetic shield attached to said frame and extending into said funnel a predetermined distance;

whereby a magnetic shielding combination is formed comprising said internal magnetic shield and said frame, said magnetic shield effectively extending from said inner surface of said faceplate through said frame and into said funnel said predetermined distance, said frame multi-functionally serving to magnetically interconnect said shield and said mask as well as to mechanically support said mask and said shield.

3. A front assembly system for a color cathode ray tube having an improved internal electrical interconnection system and magnetic shielding system comprising:

a faceplate having on its inner surface a centrally disposed target area on which is disposed at least one pattern of phosphor deposits;

a funnel attached to a peripheral sealing area on said inner surface of said faceplate, and having an internal electrically conductive funnel coating adapted to receive a high electrical potential;

an electrically conductive and magnetically permeable frame attached to said inner surface between said target area and said peripheral sealing area and enclosing said target area, said frame supporting in electrical and magnetic union therewith a tensed metallic foil, magnetically permeable shadow mask;

an electrically conductive screen disposed on said pattern of phosphor deposits electrically interconnected to said frame;

a magnetically permeable internal magnetic shield attached to said frame and extending into said funnel a predetermined distance;

electrical interconnecting means for providing an electrical interconnection between said frame and said electrically conductive funnel coating;

whereby a high-voltage conduit is formed between said funnel coating and said mask through said frame, and whereby a magnetic shielding combination is formed comprising said internal magnetic shield and said frame, said magnetic shield effectively extending from said inner surface of said faceplate through said frame and into said funnel said predetermined distance, said frame multi-functionally serving to mechanically support said interconnecting means, said mask, and said shield, and to electrically interconnect said conductive funnel coating, said conductive screen film and said mask, and to magnetically interconnect said shield and said mask.

4. A front assembly system for a color cathode ray tube having a to-screen internal magnetic shield system comprising:

a faceplate having on its inner surface a centrally disposed target area on which is disposed at least one pattern of phosphor deposits;

a funnel attached to a peripheral sealing area on said inner surface of said faceplate, said funnel lying concentric with the anterior-posterior axis of said tube;

a neck in said funnel housing an electron gun for emitting a plurality of electron beams for activating said phosphor deposits;

a magnetically permeable frame affixed to said inner surface of said faceplate between said target area and said peripheral sealing area;

a magnetically permeable tensed foil shadow mask affixed to said frame a predetermined distance from said target area to form a post-shadow mask beam-landing region defined by said mask, said target area and said frame;

a magnetically permeable internal magnetic shield affixed to said frame and extending into said funnel a predetermined distance to define, in conjunction with said mask, a magnetically shielded pre-shadow mask field-free region for the excursion of said beams;

whereby a magnetic shielding combination is formed by said frame and shield which extends to said inner surface of said faceplate to enhance the shielding of said beams from stray magnetic flux transverse to said tube axis.

* * * * *